United States Patent [19]

Saotome

[11] Patent Number: 4,837,889

[45] Date of Patent: Jun. 13, 1989

[54] CARPET RETAINING DEVICE

[76] Inventor: Kunio Saotome, 1-1-4 Nakamurakita Nerima-ku, Tokyo, Japan

[21] Appl. No.: 40,008

[22] Filed: Apr. 17, 1987

[51] Int. Cl.[4] ..... A47G 27/04

[52] U.S. Cl. ..... 16/4; 16/8; 16/16

[58] Field of Search ..... 16/4–7, 16/8, 10, 16

[56] References Cited

U.S. PATENT DOCUMENTS

| | | | |
|---|---|---|---|
| 1,836,375 | 12/1931 | Kernochan | 16/10 |
| 2,051,191 | 8/1936 | Watson | 16/16 |
| 2,554,674 | 5/1951 | Karas | 16/16 |
| 3,008,173 | 11/1961 | Goss et al. | 16/16 |
| 3,214,784 | 11/1965 | Preston | 16/8 |
| 3,528,122 | 9/1970 | Fuller et al. | 16/16 |
| 3,683,738 | 8/1972 | Kyriakos | 16/16 X |
| 4,069,542 | 1/1978 | Carder | 16/16 |

FOREIGN PATENT DOCUMENTS

| | | | |
|---|---|---|---|
| 234818 | 7/1961 | Australia | 16/8 |

*Primary Examiner*—Nicholas P. Godici
*Assistant Examiner*—Carmine Cuda
*Attorney, Agent, or Firm*—Christensen, O'Connor, Johnson & Kindness

[57] ABSTRACT

A carpet retention device or anchor (1) includes a flat, thin, floor engaging flange (11) having spaced-apart openings (14) for reception of nails (3) to anchor the retention device to the underlying floor. A thin web (12) extends upwardly from one edge of the base flange (11) to a height equal to or less than the height of the carpet pad (6). A plurality of tacks or pointed projections (13) extend transversely and slightly downwardly from the upper edge of web (12) to engage into the underside of an overlying carpet (5).

4 Claims, 4 Drawing Sheets

CARPET RETAINING DEVICE

TECHNICAL FIELD

The present invention concerns carpet retainers and, in particular, devices to retain the edge portion of a carpet, especially at locations adjacent a wall.

BACKGROUND OF THE INVENTION

As illustrated in FIG. 8, a standard manner of retaining floor carpets in place involves use of strips of plywood (a) having equally spaced-apart retention nails (b) extending upwardly from the underside of the plywood strip at an angle away from a carpet (g) being retained. The plywood strip (a) is secured to the underlying floor (d) by larger nails (e) extending downwardly through the plywood strip and into the floor. The carpet (g) is placed over a pad (f) which is slightly thicker than the thickness of the plywood strip (a).

As shown in FIG. 8, the plywood strip (a) is positioned a short distance away from wall (c). The carpet (g) is retained by forcing the edge of the carpet (g) into the space between the wall (c) and the adjacent edge of the plywood strip (a) thereby causing the retention nails (b) to engage into the underside of the carpet.

One drawback of using retainers in the form of plywood strips (a) to hold floor carpets in place is that if downward pressure is applied near the edge of the carpet, for instance such as by walking, an upward force is exerted on the edge portion of the carpet which may result in disengagement of the carpet from the retention nails (b). In addition, if the retention nails are too long, the upper tips of the nail may extend upwardly through the carpet, possibly engaging the sole of the shoe of a person walking on the carpet or even puncturing the bottom of the foot of the walker, if barefoot or in stocking feet.

One purpose of the present invention is to overcome the foregoing disadvantages of using plywood strips, such as strips (a), to retain carpets.

SUMMARY OF THE INVENTION

In accordance with the present invention, a carpet retention device includes a base section anchorable to a floor or wall and an upright first web portion that extends upwardly from the base section to extend along the edge of a pad that underlies the carpet. Preferably, the first web portion extends along and is spaced slightly outwardly from a wall or other abutment at the edge of the carpet thereby to define a gap between the first web portion and the wall. The carpet retention device of the present invention also includes tack means extending generally transversely to the upper edge of the first web portion in a direction away from the carpet pad, and ideally in a slightly downwardly direction. When laying the carpet, the edge portion of the carpet is forced downwardly into the gap between the first web portion and the wall thereby to be retained by the tacks which engage into the underside of the carpet.

In accordance with a further aspect of the present invention, the entire carpet retention device including the base section, the upright first web portion and the tacks are all formed from an integral, singular member.

In accordance with a further aspect of the present invention, V-shaped notches are formed in the base section of the carpet retention device with the apex of such notches located adjacent the intersection of the base section and the upright first web portion of the retention device. The notches enable the carpet retention device, and in particular, the upright first web portion, to be manually bent about the apex of the notch thereby to bend or curve the carpet retention device around the corners of a room or other area in which the carpet is being laid.

In a specific aspect of the present invention, the carpet retention device of the present invention is generally angled-shaped having a base section in the form of a flat floor engaging base flange. A plurality of openings are provided in the base flange for a reception of nails that extend downwardly through the base flange to anchor the carpet retention device to the floor. The first web portion extends upwardly from an edge portion of the base flange. A plurality of tacks extend transversely from the upper edge of the first web portion in a direction away from the carpet proper, i.e., the major portion of the carpet as opposed to the outer edge portion of the carpet. Ideally, the tacks extend slightly diagonally downwardly to engage within the underside of the carpet being retained.

In accordance with a further specific aspect of the present invention, the carpet retention device of the present invention is generally channel or U-shaped, having a base section in the form of a flat flange that lies on the floor between a gap defined by a vertical wall or abutment and the upright first web portion. The base section also includes a second web portion that extends upwardly from the edge of the base flange opposite the first web portion thereby to extend upwardly against the adjacent face of the wall. A plurality of spaced-apart openings are formed in the second web portion to enable screws, nails or other types of fasteners to extend into the wall to thereby anchor the carpet retention device in place. This embodiment for the present invention is especially advantageous when it is impractical of undesirable to fasten the base section of the carpet retention device to the floor, for instance if the floor is constructed from stone or masonry material, such as brick or concrete.

In accordance with an additional specific aspect of the present invention, the carpet retention device of the present invention is generally Z-shaped, having a base section in the form of a first, floor engaging flange underlying the adjacent edge portion of the carpet pad. Preferably, spaced-apart holes are formed in the first or base flange for nails that extend downwardly through such openings and into the floor to anchor the carpet retention device in place. The carpet retentin device also includes a web portion extending upwardly from the base flange to extend along the outer edge of the carpet path. A second flange extends transversely from the upper edge of the web portion in a direction away from the first flange, i.e., away from the carpet pad and toward a wall, if any. A plurality of integral tacks project outwardly from the free edge portion of the second flange, and preferably in a slightly downwardly direction to engage within the underside of the carpet which was forced downwardly over the second flange portion. A plurality of auxiliary tacks may be struck out in the upwardly direction from the second flange to extend diagonally upwardly and away from the carpet proper. The auxiliary tacks engage in the underside of the overlying carpet to assist in retaining the carpet in place.

BRIEF DESCRIPTION OF THE DRAWINGS

The details of typical embodiments for the present invention will be described in connection with the accompanying drawings in which.

DETAILED DESCRIPTION

Figure 1:
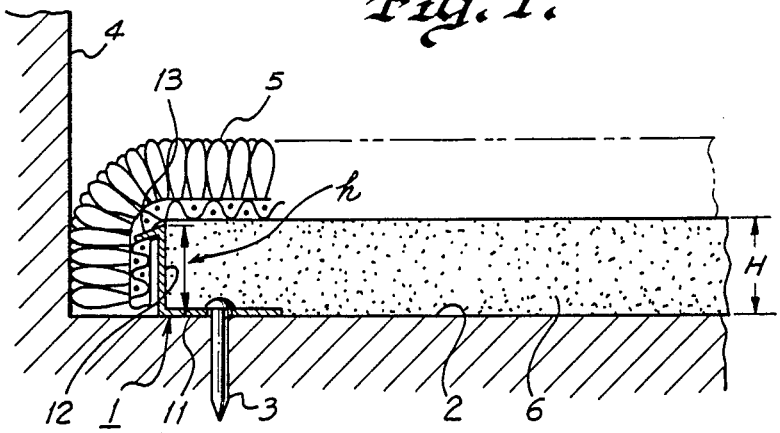
FIG. 1 is a cross-sectional view of a first preferred embodiment of the carpet retention device of the present invention illustrated in use.
Figure 2:
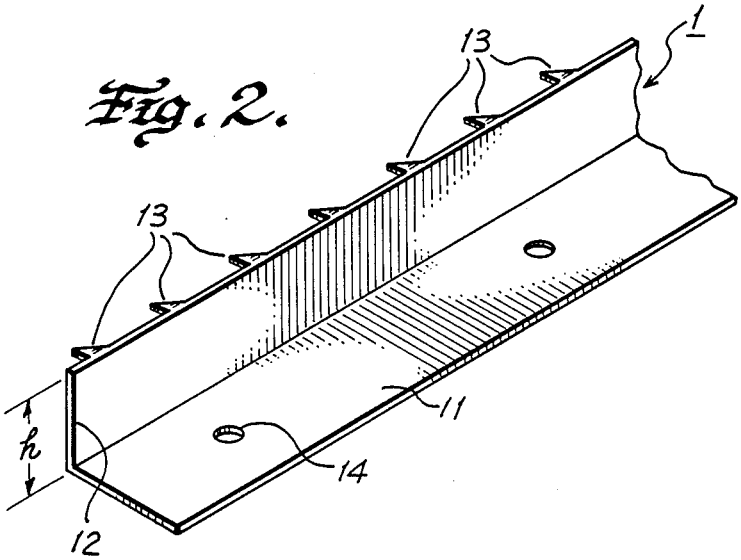
FIG. 2 is an isometric view of the embodiment of the present invention illustrated in FIG. 1.

As illustrated in FIGS. 1 and 2, a first preferred embodiment of a carpet retention device or anchor 1 constructed according to the present invention is formed in a generally angle-shape. The retention device 1 includes a base section in the form of a flat flange 11 for overlying the floor 2 at a location spaced slightly outwardly from wall 4. A plurality of opening or holes 14 are formed in base flange 11 to receive hardware members, for instance in the form of nails 3, which extend downwardly therethrough and into the floor 2 thereby to anchor the retention device 1 in place. A first web 12 extends upwardly from the side edge of base flange 11 located away from the carpet proper, i.e., toward wall 4. As shown in FIG. 2, the base flange 11 and the first web 12 define the carpet retention device 1 in a generally angle-shape.

A plurality of pointed tacks 13 extend transversely from the upper edge of first web 12 in the direction opposite to base flange 11. Preferably, tacks 13 project slightly downwardly, see FIG. 1. Ideally, tacks 13 are integrally formed with web 13 in a generally V-shape. Also ideally, the tacks 13 are uniformly spaced along the upper edge of web 12 from about 30 to 50 millimeters apart from each other.

Preferably, the entire carpet retention device 1 is constructed from the singular member which is bent or otherwise formed to define the shape of the device. Also preferably, carpet retention device 1 is constructed from a high strength, formable material, such as sheet metal or stainless steel.

In use, the carpet retaining device 1 is anchored to floor 2 by nails 3 extending downwardly through openings 14 formed in base flange 11. Preferably, the carpet retention device 1 is located slightly outwardly from wall 4 to define a gap "g" therebetween. After the retention device 1 has been anchored in place, carpet pad 6 is laid over the floor 2 so that the outer edge of the carpet pad lies adjacent the first web 12. Ideally, the thickness H of the carpet pad 6 is somewhat greater than the height h of the web 12 so that the bottom of the carpet 5 does not have to extend upwardly from the pad to pass over the upperedge of the web.

To retain carpet 5 in place, the outer edge of the carpet is forced downwardly into gap "g" thereby causing tacks 13 to engage into the underside of the carpet, and thus hold the carpet in place. Because tacks 13 extend either horizontally toward wall 4 or in a slightly downwardly direction, it will be appreciated that carpet 5 will be securely retained by tacks 13 even if the adjacent portion of the carpet is pulled in the upwrdly direction by a person walking along the edge of the carpet. In addition, because tacks 13 do not point in an upwardly direction, the tacks will not cause any harm to the soles of a person's feet or shoes when walking over the retention device 1.

It will be appreciated that the retention device 1 shown in FIGS. 1 and 2 may be formed in convenient lengths, for instance from one to several meters in length. The retention device may be conveniently cut to a desired length with a pair of tin snips or other appropriate shearing or cutting device. Alternatively, if carpet retention device 1 is formed from thin metallic material, sections of the retention device may be placed in overlapping relationship on each other, rather than having to cut the retention device.

Figure 3:
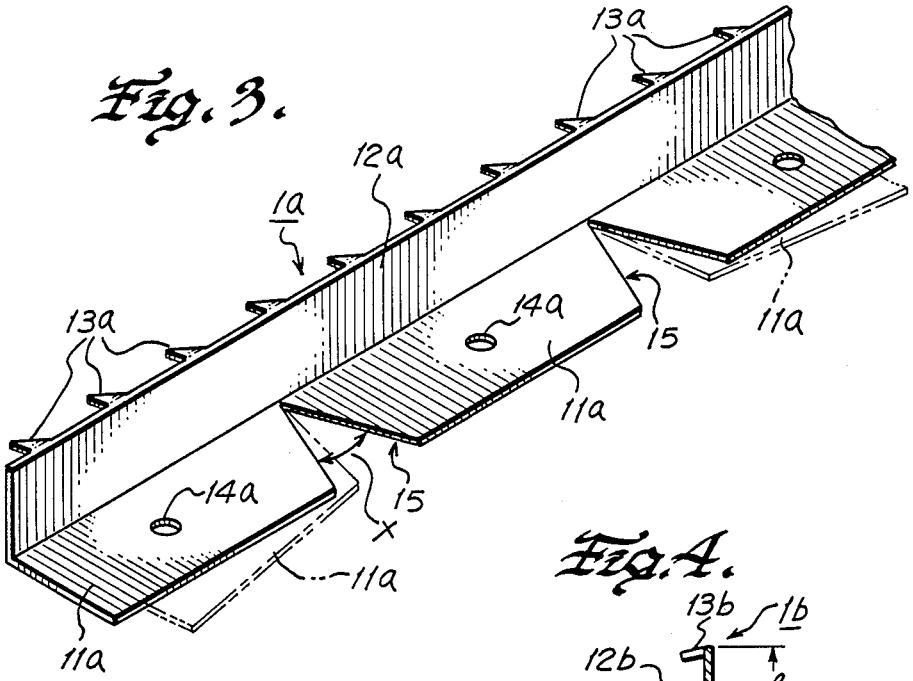
FIG. 3 is an isometric view of a further preferred embodiment of the present invention.

Another preferred embodiment of the present invention is illustrated in FIG. 3, wherein the retention device 1*a* is constructed substantially identically with the retention device 1 shown in FIGS. 1 and 2 with the exception that a plurality of generally V-shaped notches 15 are formed in base flange 11*a*. In the embodiment of retention device 1*a* is shown in FIG. 3, the components thereof which are identical or comparable to corresponding components of the retention device shown in FIGS. 1 and 2 are given the same part numbers but with the designation "a." The dissimilar components are given new part numbers. This same numbering system is used in the further preferred embodiments of the present invention shown in FIGS. 4–7 and 9, discussed below.

As shown in FIG. 3, notches 15 are generally V-shaped with the apex 15*a* of the notches located at the intersection of base flange 11*a* and first web 12*a*. As shown in phantom line in FIG. 3, notches 15 permit the retention device 1*a* to be manually bent about the apex 15*a* of the notch, for instance when extending around the corner of the room or other area in which carpet is being laid. The angle "x" of the notch 15 determines the extent to which retention device 1*a*, and in particular web 12*a*, may be bent. A plurality of notches 15 are formed in base flange 11*a* at locations spaced apart from each other along the length of the base flange. This enables the retention device 1*a* to be manually bent at a single desired location, for instance, at precisely the corner of the carpet, and also enables the retention device 1*a* to be formed in a desired curvature, for example, by manually bending the retention device at a series of notches 15.

Figure 4:
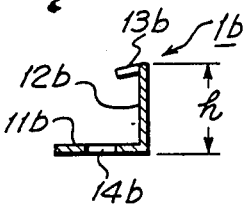
FIG. 4 is a cross-sectional view of another preferred embodiment of the present invention.

A further alternative embodiment of the present invention is illustrated in FIG. 4. A carpet retention device 1*b* is formed in a generally angle-shape that is the "reverse" of the device shown in FIGS. 1 and 2. In the carpet retention device 1*b*, base flange 11*b* extends transversely from the lower edge of first web 12*b* in the same direction as the direction that tacks 13*b* project from the upper edge of the first web. In all other respects, the carpet retention device 1*b* shown in FIG. 4 is constructed in the same manner as the carpet retention device 1 shown in FIGS. 1 and 2. One advantage of forming carpet retention device 1*b* in the manner shown in FIG. 4 is that by positioning the free edge of base flange 11*b* against a wall, not shown, or other vertical member, a uniform gap is maintained between the wall, not shown, and first web 12*b*. The carpet retention device 1*b* shown in FIG. 4 is utilized in substantially the same manner as the carpet retention device shown in FIGS. 1 and 2. Also, as in carpet retention device 1*a* shown in FIG. 3, the carpet retention device 1*b* shown in FIG. 4 may be formed with a plurality of notches, not shown, so that the retention device 1*b* may be conveniently bent or curved to correspond with the outer perimeter of the carpet being laid.

Figure 5:
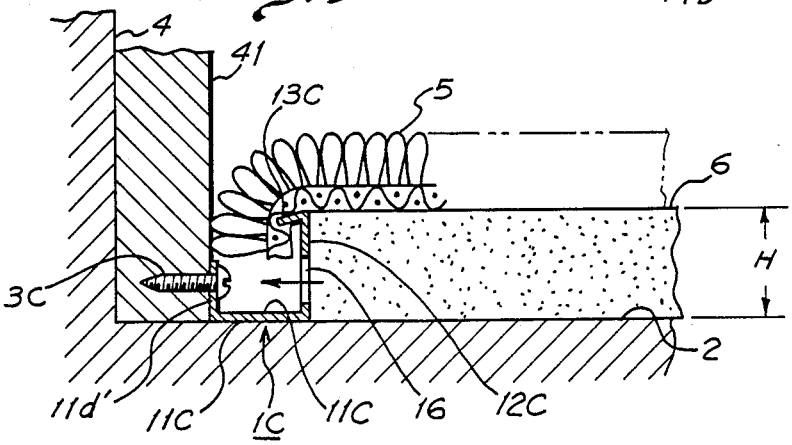
FIG. 5 is a cross-sectional view of a further preferred embodiment of the present invention illustrated in use.
Figure 6:
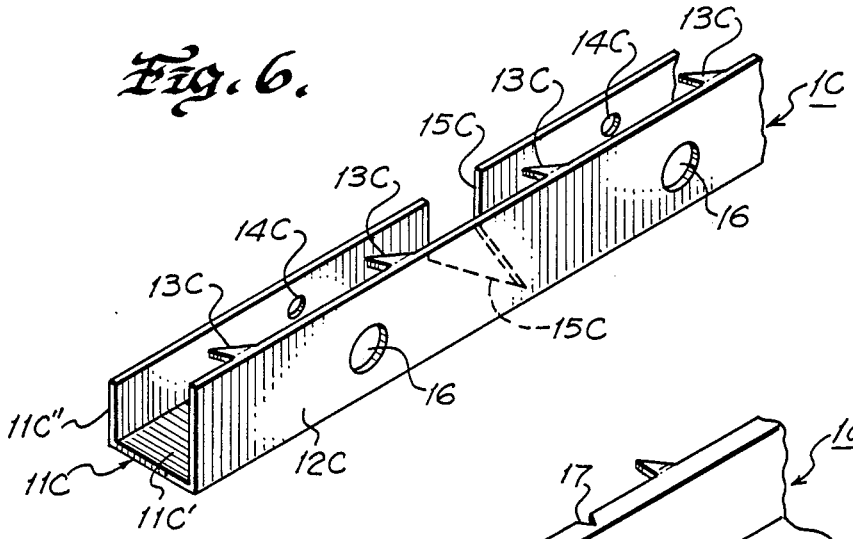
FIG. 6 is an isometric view of the embodiment of the present invention shown in FIG. 5.

A further preferred embodiment of the present invention is illustrated in FIGS. 5 and 6 wherein a carpet retention device 1*c* is formed in a generally channel or U-shape, preferably constructed from a unitary member formed into such shape. The carpet retention device 1*c* includes a first web 12*e* and a plurality of tacks 13*c* projecting from the upper edge of the first web in a manner similar to the carpet retention devices 1, 1*a* and 1*b* shown in FIGS. 1–4. In addition, the carpet retention device 1*c* includes a base flange 11*c*′ extending transversely from the bottom edge of web 12 in the same general direction as tacks 13 to overlie the floor 2 in a manner similar to base flange 11*b* shown in FIG. 4. In addition, a second web 11*c*″ extends upwardly from the side edge of base flange 11*c*′ opposite first web 12 to extend along the face of the wall molding 41.

The carpet retention device may be anchored to the wall molding 41 by screws 3*c* or other appropriate hardware members that extend through close fitting holes or openings 14*c* formed in second web 11*c*″. Larger clearance openings 16, in alignment with the smaller openings 14*c*, are formed in first web 12 to enable screws 13*c* to be conveniently installed into molding 41. It can be appreciated that rather than anchoring carpet retention device 1*c* to molding 41, the carpet retention device may be attached directly to wall 4, and then the molding, if used, can be positioned over the carpet retention device 1*c* in a manner which is well known.

It will be appreciated that use of the carpet retention device 11*c* may be especially advantageous in situations in which it is impractical or undesirable to anchor the carpet retention device directly to the floor 2, for instance if the floor is constructed from stone or masonry. The carpet retention device 1*c* could, however, be constructed with a plurality of spaced-apart openings, not shown, formed in base flange 11*c*′ to enable the retention device to be fastened directly to floor 2 if desired.

As in the embodiment of the present invention shown in FIGS. 1 and 2, and as in each of the other embodiments of the present invention described and illustrated herein, carpet retention device 1*c* preferably is formed in convenient lengths of, for instance, from one to several meters in length. Also, as in each of the various embodiments of the present invention described and illustrated herein, ideally carpet retention device 1*c* is constructed so that it may be manually bent to form interior or exterior corners or curvatues to coincide with the shape of the perimeter of carpet being laid. To this end, as shown in FIG. 6, V-shaped notches 15*c* are formed in base flange 11*c*′ with a corresponding gap 15*c*′ formed in the second web 11*c*″. This enables a first web 12 to be conveniently manually bent about the apex of the notch 15*c*.

Figure 7:
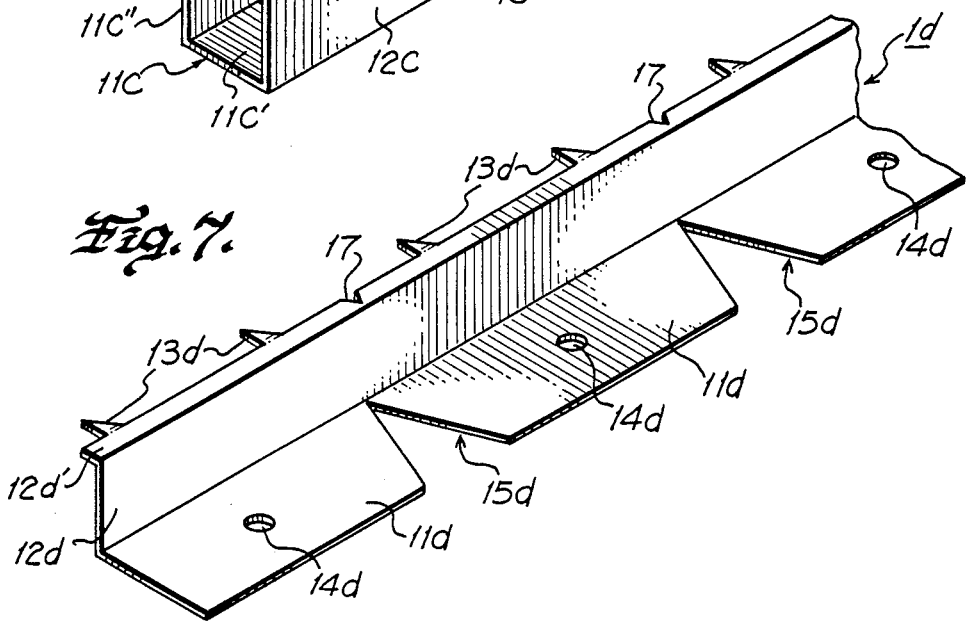
FIG. 7 is an isometric view of an additional preferred embodiment of the present invention.
Figure 8:
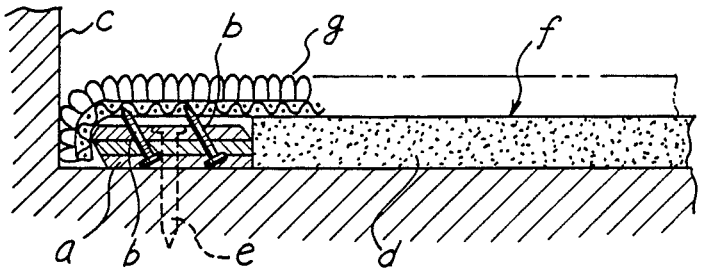
Fig. 8. (PRIOR ART)
FIG. 8 illustrates in cross section a known device, shown in use,for retaining a carpet; and, FIG. 9 is an isometric view of a further preferred embodiment of the present invention.

Another preferred embodiment of the present invention is shown in FIG. 7. The carpet retention device 1*d* shown in FIG. 7 is generally Z-shaped having a base flange 11*d* and a first vertical web 12*d* in a manner similar to the retention device 1 shown in FIGS. 1 and 2. Also in a manner similar to the retention device 1*b* shown in FIG. 3, a plurality of spaced-apart, V-shaped notches 15*d* are formed in base flange 11*d* to serve the same purpose as notches 15. In a manner dissimilar from the carpet retention device as previously described, the carpet retention device 1*d* includes a second, upper flange 12*d*′ extending generally transversely from the upper edge of web 12*d* in the direction opposite to the direction that base flange 11*d* extends from the bottom of web 12*d*.

In a manner similar to the carpet retention devices 1 through 1*c* previously described, a plurality of pointed tacks 13*d* project outwardly from upper flange 12*d*′ and ideally such tacks extend slightly downwardly. It will be appreciated that forming carpet retention device 1*d* with upper flange 11*d*′ increases the structural integrity of the carpet retention device thereby enabling the device to carry higher loads than if the device was constructed without the upper flange.

It is to be understood that base flange 11*d* could be formed to extend transversely from the bottom of web 12*d* in the same direction as upper flange 12*d*′, thus forming a generally "C-shaped" structure without departing from the spirit or scope of the present invention. Such a C-shaped structure would also provide the advantage provided by the carpet retention device 1*b* shown in FIG. 4 and described above.

As in all of the embodiments of the carpet retention devices of the present invention described and illustrated herein, preferably carpet retention device 1*d* is formed on the singular unitary member, for instance from sheet metal stock or stainless steel. It will be appreciated that the shape of carpet retention device 1*d* may be cut or punched from the sheet stock and then bent or otherwise formed into the shape shown in FIG. 7. Alternatively, the carpet retention device 1*d* may be constructed from two or more separate members that are welded, riveted or otherwise fastened together.

Ideally, the carpet retention device 1*d* shown in FIG. 11 is adapted to be bent or curved to form corners or follow the contour of the edge of the carpet being laid. To this end, V-shaped notches 15*d* are formed in base flange 11*d* at spaced-apart locations along the length of the base flange. In addition, corresponding notches 17 are formed in upper flange 12*d*′ with the apexes of the notches 15*d* and 17*d* ideally in vertical alignment with each other.

Figure 9:
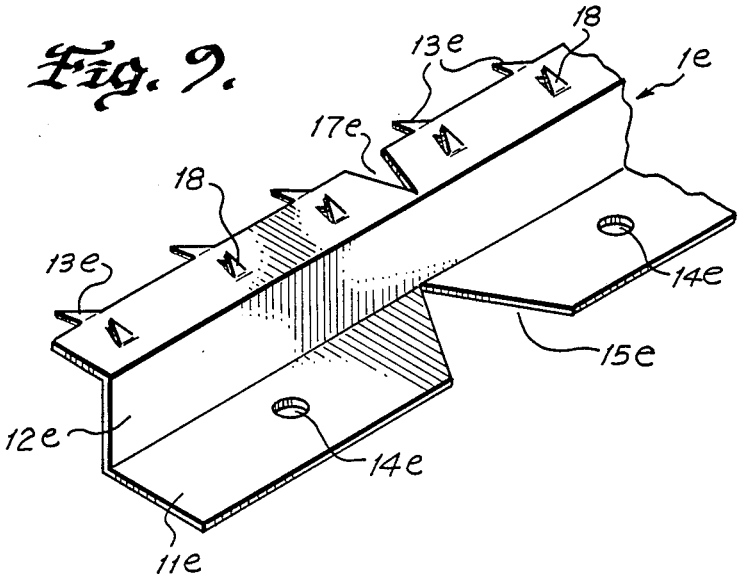

A further preferred embodiment of the present invention is illustrated in FIG. 9. The carpet retention device 1*e* shown in FIG. 9 is constructed somewhat similarly to the carpet retention device 1*d* shown in FIG. 7, with the exception that the upper flange 12*e*′ is somewhat wider than upper flange 12*d*′ shown in FIG. 7. Forming upper flange 12*e*′ in such increased width enables a plurality of auxiliary tacks 18 to be struck out from the upper flange 12*e*′. As shown in FIG. 9, the auxiliary tacks 18 are generally V-shaped with pointed tips that are struck out in the upwardly direction from upper flange 12*e*′ to engage into the underside of a carpet, not shown. The auxiliary tacks 18 provide additional resistance to horizontal loads on the carpet, not shown, extending in the direction of the carpet proper.

As in the carpet retention device 1*d* shown in FIG. 7, the carpet retention device 1*e* illustrated in FIG. 9 also is adapted to be bent to form a corner or to form a curve to correspond to the shape of the edge of a carpet. To this end, a plurality of V-shaped notches 15*e* are formed in base flange 11*e* and comparable notches 17*e* formed in upper flange 12*e'*, with the apexes or corresponding notches 15*e* and 17*e* in vertical alignment with each other.

Ideally, all of the carpet retention devices 1, 1*a*, 1*b*, 1*c*, 1*d* and 1*e* are fabricated from a unitary piece of material, for instance from thin sheet metal stock. As an illustrative but nonlimiting example, the retention devices could be formed from sheet steel stock of various thickness, for instance from about 0.07 mm (23 gauge) to 1.5 mm (16 gauge). This enables the retention devices to be conveniently and economically manufactured in standard lengths. To resist corrosion, for instance from moisture, the steel material may be plated, for instance, with galvanized plating, painted, etc. Alternatively, the steel material itself may be corrosion resistant, i.e., stainless steel.

As an alternative construction, the retention devices may be formed from two or more pieces that are welded, riveted or otherwise fastened together. The carpet retention devices of the present invention are designed to be positioned end-to-end to extend along the edge of the carpet being laid. If desired, the various lengths of the carpet retention devices may be welded or otherwise fastened together to form longer lengths. Moreover, although not shown, the carpet retenton devices can be cross-scored at longitudinal intervals to enable the retention devices to be conveniently broken or cut by hand to a desired length. This would eliminate the need to either saw, shear or otherwise cut the carpet retention devices to desired lengths.

Although the various peferred embodiments of the present invention discussed above have been described as being anchorable to a floor or wall by nails 3 or other appropriate fastener members, it will be appreciated that such retention devices may be glued or otherwise attached to the floor or wall.

As will be apparent to those skilled in the art to which the invention is addressed, the present invention may be embodied in other forms than those specifically disclosed above without departing from the spirit or scope of the invention. The particular embodiments of the carpet retention devices described above are therefore to be considered in all respects as illustrative, and not restrictive. The scope of the present invention is as set forth in the appended claims rather tha being limited to the examples of the carpet retention devices discussed in the foregoing description.

The embodiments of the invention in which an exclusive property or privilege is claimed are defined as follows:

1. A carpet retaining device for anchoring the edge of a carpet overlying a floor adjacent a wall, comprising:

a base flange anchorable to the floor;

an upright first web extending upwardly from a first edge of said base flange;

tack means extending generally transversely to the upright first web and lying directly above said base flange for engaging the edge of the carpet;

an upright second web extending upwardly from a second edge of said base flange and spaced away from the first web, the second web and the base flange having portions defining at least one notch to enable the first web to be bent at the location of such notch; and a means for attaching said second web to the wall.

2. The carpet retention device of claim 1, wherein said means for attaching said second web to the wall comprises:

a plurality of smaller openings formed in the second web; and a plurality of larger clearance openings formed in the first web, the clearance openings being aligned with and permitting access to corresponding smaller openings.

3. A substantially rigid carpet retention device for anchoring the edge of a carpet overlying a floor, comprising:

a base flange anchorable to the floor;

an upright first web extending upwardly from the base flange, said upright first web having an upper edge;

an upper flange extending transversely from the upper edge of the first web and lying directly above said base flange;

a set of primary tacks projecting from a free edge of said upper flange and disposed generally transversely to the upright first web for engaging the edge of the carpet; and a set of auxiliary tacks projecting generally transversely and slightly upwardly from said upper flange for further engaging the edge of the carpet.

4. The carpet retention device of claim 3, wherein said base flange and said upper flange having portions defining notches to enable the first web to be bent at the location of the notches.

* * * * *